US005996562A

United States Patent [19]

Plog et al.

[11] Patent Number: 5,996,562

[45] Date of Patent: Dec. 7, 1999

[54] PROCESS FOR DRAWING VOLATILE COMPONENTS OUT OF FUEL IN A TANK

[75] Inventors: Carsten Plog, Markdorf; Renato Andorf, Meckenbeuren; Thomas Stengel, Friedrichshafen, all of Germany

[73] Assignee: Dornier GmbH, Germany

[21] Appl. No.: 09/055,309

[22] Filed: Apr. 6, 1998

[30] Foreign Application Priority Data

Apr. 4, 1997 [DE] Germany ..... 197 13 841

[51] Int. Cl.[6] ..... F02B 51/00; F02M 25/08; F02M 27/00

[52] U.S. Cl. ..... 123/576; 123/179.8; 123/518; 423/235; 423/212 R

[58] Field of Search ..... 208/366, 308, 208/347; 44/300, 639; 210/767, 808, 908; 123/518, 525, 544, 576, 179.8; 423/235, 212 R

[56] References Cited

U.S. PATENT DOCUMENTS 3,783,849 1/1974 Bramfitt ..... 123/127
3,794,000 2/1974 Hodgkinson ..... 123/133
3,851,633 12/1974 Shih ..... 123/127
4,413,594 11/1983 Hirota ..... 123/3

OTHER PUBLICATIONS

Perry et al. Chemical Engineers' Handbook 5th Edition McGraw Hill Book Co. USA ISBN 0–07–049478–9 pp. 16–11 to 16–13, 1973.

Kohl et al. Gas Purification 4th Edition Gulf Publishing Co. Houston TX USA ISBN 0–87201–314–6 pp. 773 and 778, 1985.

*Primary Examiner*—Wayne Langel
*Assistant Examiner*—Timothy C Vanoy
*Attorney, Agent, or Firm*—Evenson, McKeown, Edwards & Lenahan, P.L.L.C.

[57] ABSTRACT

A process is provided for drawing low-boiling volatile components, such as 2-methylbutane, 2,3-dimethylbutane and pentane, out of fuel in a fuel tank of a passenger car or utility vehicle by applying a vacuum to the fuel tank by means of a diaphragm pump; suctioning off the low-boiling volatile components and condensing the low-boiling volatile components under a pressure that is greater than 1.0 bar. The low-boiling volatile components may be stored in a storage tank and used as engine fuel during cold start of the engine or used as a reducing agent for nitrogen oxides in the exhaust gas from the engine.

8 Claims, 3 Drawing Sheets

PROCESS FOR DRAWING VOLATILE COMPONENTS OUT OF FUEL IN A TANK

This application claims the priority of German patent document 197 13 841.1, filed Apr. 4, 1997, the disclosure of which is expressly incorporated by reference herein.

BACKGROUND AND SUMMARY OF THE INVENTION

The invention relates to a process and apparatus for the fractionation of engine fuel on board a motor vehicle.

In motor vehicles having an internal-combustion engine, specific fractions of commercially available engine fuel are required for special uses. It is known, for example, that in vehicles with Otto engines the use of low-boiling fuel fractions in the cold-start phase lowers the hydrocarbon emissions.

It is an object of the invention to provide a process for separating a low-boiling fuel fraction from an engine fuel on board a motor vehicle, which requires only a small space and is lightweight. Furthermore, the required low-boiling fuel fraction must be available as early as at the start of the vehicle.

This object is achieved by the process according the invention, in which the fractionation of the fuel takes place by means of a gas delivery pump by vacuum evaporation with a subsequent pressure condensation. The process can be carried out at ambient temperatures, so that no additional feeding or removal of heat is required.

The separated low-boiling fuel fraction is particularly suitable for use as engine fuel which lowers the hydrocarbon emissions during the cold start phase of the engine.

Furthermore, the separated low-boiling fuel fraction can be utilized as a reducing agent for nitrogen oxides removal catalysts in the lean engine exhaust gas.

The fractionation of the fuel can take place from the fuel supply tank of the motor vehicle or from an additionally existing intermediate tank. In the latter case, the higher-boiling fraction remaining after the separation can be used as engine fuel in engine operating phases suitable for this purpose.

Because of the above-mentioned advantages, the process according to the invention is suitable for use in all mobile systems, such as passenger cars and utility vehicles.

The equipment-related expenditures for carrying out the process are low. Moreover, complex components, such as evaporators, are not required, so that the space and the weight can be kept low.

Lowest-boiling compounds, such as butane, which can be condensed during distillation only with very substantial cooling (<0° C.), can be obtained by the process according to the invention at comparatively low expenditures.

Another important advantage of the process according to the invention lies in the fact that, because of the electric power available in the motor vehicle, the desired fuel fraction can be provided for the operation of the gas delivery pump immediately at the start of the engine. Thus, a supply tank for this fuel fraction is not necessary.

By constantly suctioning-off the gas phase from the fuel tank, evaporation losses are largely avoided. As a result, the hydrocarbon emissions from the fuel tank are lowered and the efficiency of the motor vehicle is increased.

Other objects, advantages and novel features of the present invention will become apparent from the following detailed description of the invention when considered in conjunction with the accompanying drawings.

DETAILED DESCRIPTION OF THE DRAWINGS

Figure 1:
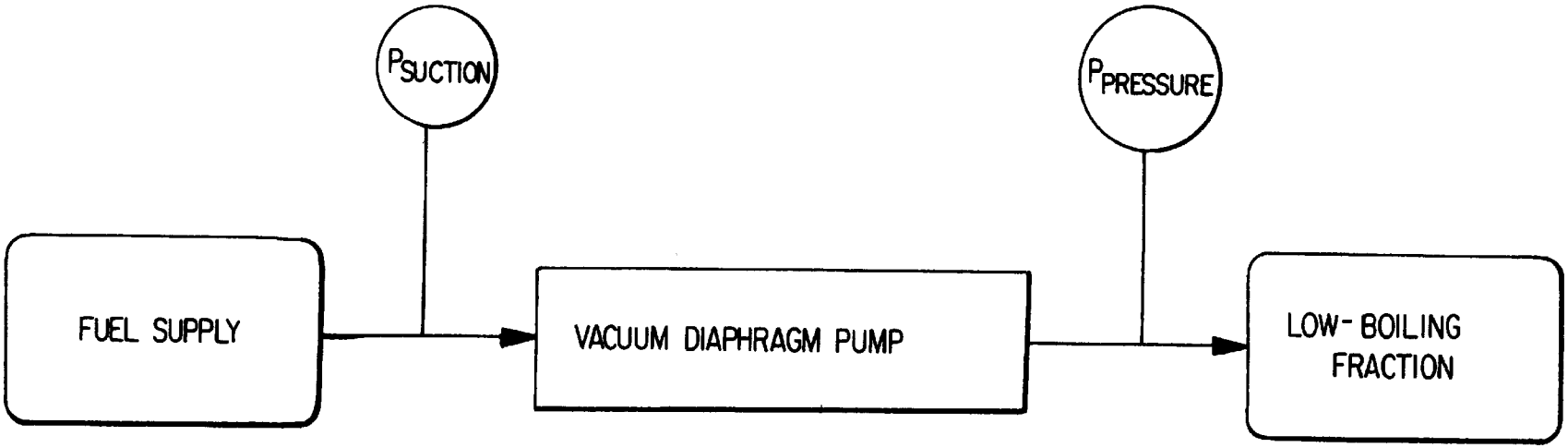
FIG. 1 is a schematic representation of the process according to the invention.

The process according to the invention is explained in detail in FIG. 1. The low-boiling constituents are evaporated in the fuel tank by way of the vacuum ($P_{suction}$) generated by the gas delivery pump. On the delivery side of the pump, these constituents are condensed again by the higher pressure ($P_{pressure}$). Depending on the type of pump (that is, the design of the pump, including pressure on the suction and delivery side), the desired boiling range of the low-boiling fraction can be set; and by way of the pump output, the required fractionation time can be set.

Vacuum diaphragm pumps were found to be particularly suitable for this purpose, since they operate without servicing (without oil); have a high service life; and are insensitive to media condensing in the pump. The electric power demand of such a diaphragm pump is also low (<200 W).

Preferred values for $P_{suction}$ and $P_{pressure}$ are:

$P_{suction}<1$ bar, particularly $P_{suction}<300$ bar, $P_{pressure}>1$ bar, particularly 1 bar$<P_{pressure}\leqq 2$ bar, Significantly, the process according to the invention can be carried out particularly at ambient temperatures. However, to increase the fractionation rate, the suction side of the gas delivery pump can also be heated and/or the delivery side of the gas delivery pump can be cooled.

Figure 2:
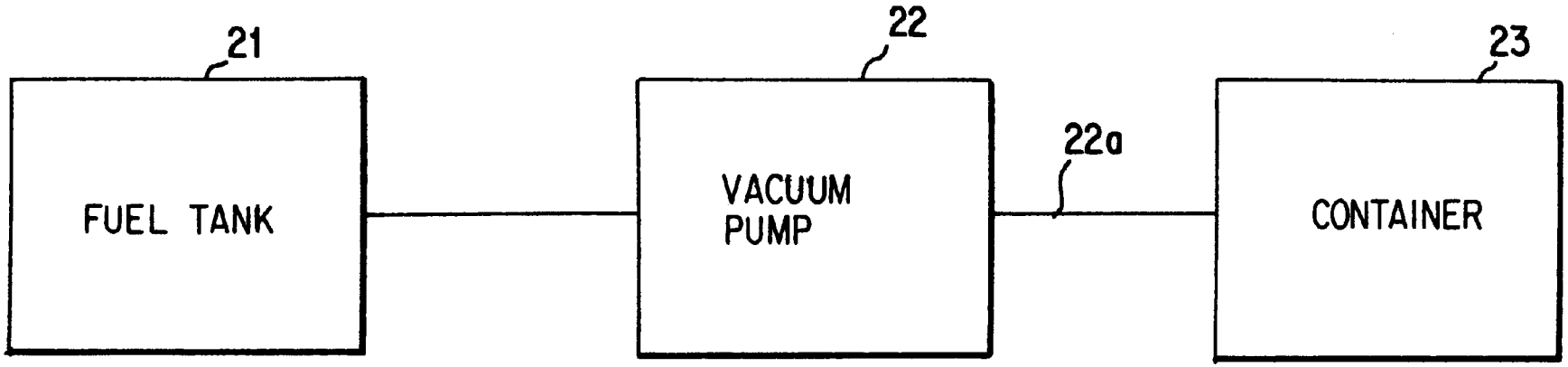
FIG. 2 is a schematic illustration of apparatus for performing the method of FIG. 1.

FIG. 2 depicts apparatus for fractionation of fuel according to the invention. The fuel may be contained in fuel tank 21 which may be either the main fuel tank or an intermediate fuel tank. The vacuum pump 22 evacuates the tank 21, causing constituents having a low boiling point to evaporate. At the delivery side 22*a* of the pump 22 prevailing a pressure which is preferably in the range of 1 to 2 bar as noted previously. At this pressure the previously evaporated constituents are condensed and collected in the container 23.

Figure 3:
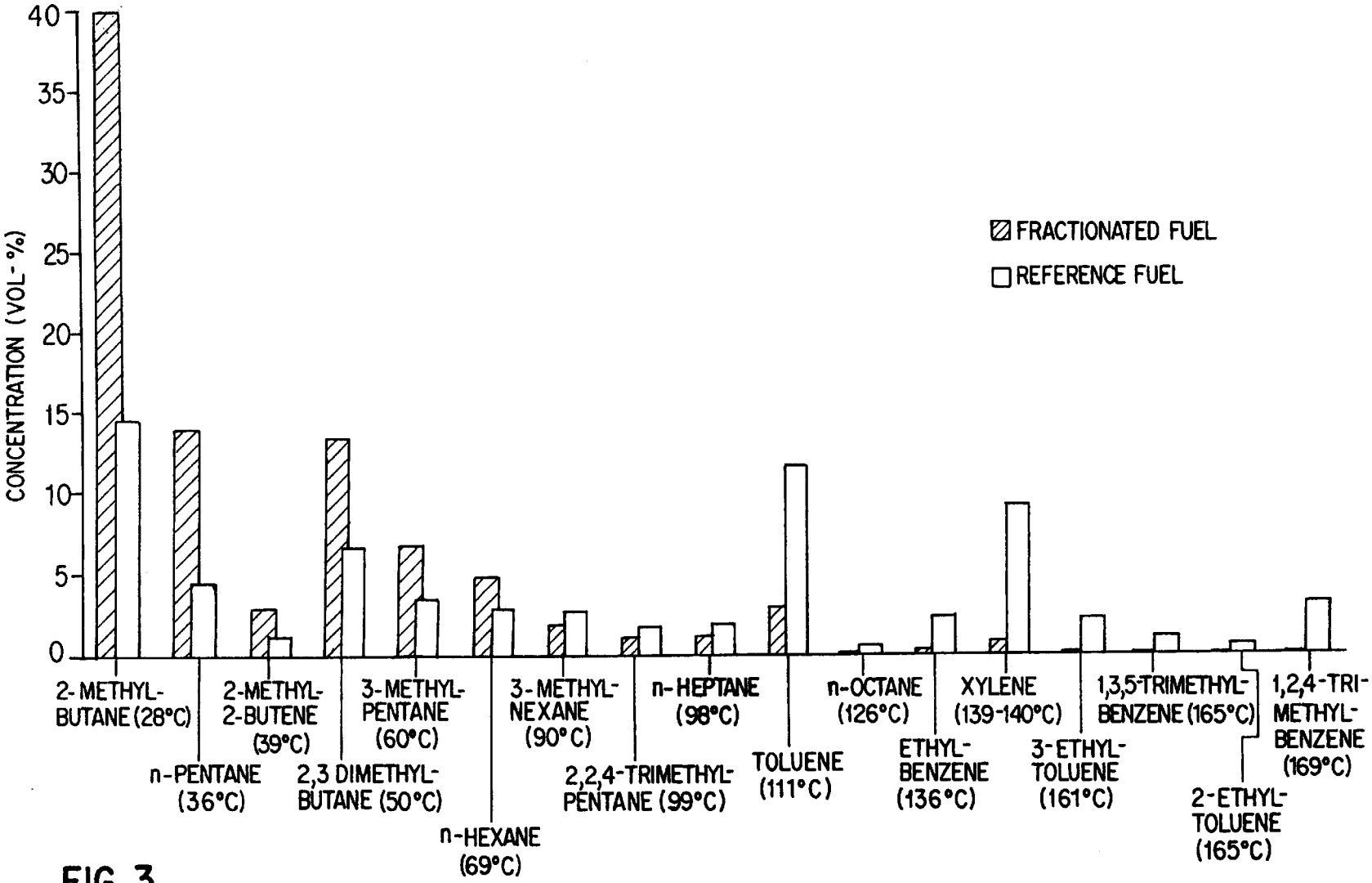
FIG. 3 is a diagram which shows the composition of a low-boiling fuel fraction obtained according to the invention.

FIG. 3 shows the composition of a low-boiling fuel fraction obtained by the process according to the invention (shaded bars) in a comparison with the composition of the initial fuel before the separation. The boiling points of the individual constituents are indicated in parentheses. The pressure on the suction side in this case was 100 to 300 mbar; on the delivery side, it was 1 to 2 bar. As illustrated in FIG. 2, low-boiling constituents are considerably enriched, whereas there are almost no higher-boiling fuel constituents (aromatic compounds, among others).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Process for providing a low-boiling point fuel fraction to an internal combustion engine by separating said low-boiling fuel fraction from an engine fuel contained in a fuel tank on board a motor vehicle, said process comprising:

applying a vacuum to fuel in the fuel tank, wherein constituents of the low-boiling fuel fraction to be separated from said fuel in the fuel tank, are evaporated;

suctioning off evaporated constituents of the low-boiling fuel fraction from the fuel tank; and condensing the constituents of the low-boiling fuel fraction by means of pressure which is greater than 1.0 bar.

2. Process according to claim 1 wherein pressure during evaporation of the constituents of the low-boiling fuel fraction is lower than 1 bar.

3. Process according to claim 1 the fuel is selected from the group consisting of Otto fuel, Diesel fuel and kerosene.

4. Process according to claim 1 wherein the fuel tank is an intermediate tank which exists in addition to the fuel supply tank of the motor vehicle.

5. Process according to claim 1 further comprising the step of using the low-boiling fuel fraction as a reducing agent for a nitrogen oxides removal catalyst in a lean exhaust gas.

6. Process according to claim 1 wherein a diaphragm pump is used to apply the vacuum to the fuel in the fuel tank.

7. Process according to claim 1 further comprising the step of supplying the constituents of the low-boiling fuel fraction to the engine of the motor vehicle during cold start of said engine.

8. Process according to claim 1 further comprising the step of collecting said constituents of the low-boiling fuel fraction in a storage tank.

* * * * *